US011495177B2

(12) United States Patent
Lin et al.

(10) Patent No.: US 11,495,177 B2
(45) Date of Patent: Nov. 8, 2022

(54) IMAGE PROCESSING CIRCUIT AND METHOD FOR COMPENSATING FOR IR DROP ON DISPLAY PANEL

(71) Applicant: NOVATEK Microelectronics Corp., Hsin-Chu (TW)

(72) Inventors: Hui-Feng Lin, Taichung (TW); Yen-Tao Liao, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/368,838

(22) Filed: Jul. 7, 2021

(65) Prior Publication Data

US 2022/0013068 A1 Jan. 13, 2022

Related U.S. Application Data

(60) Provisional application No. 63/050,870, filed on Jul. 12, 2020.

(51) Int. Cl.
*G09G 3/3233* (2016.01)

(52) U.S. Cl.
CPC ... *G09G 3/3233* (2013.01); *G09G 2320/0233* (2013.01); *G09G 2320/045* (2013.01)

(58) Field of Classification Search
CPC ..... G09G 3/3233; G09G 2320/0233; G09G 2320/045; G09G 2320/0223
See application file for complete search history.

(56) References Cited

U.S. PATENT DOCUMENTS

| | | | | |
|---|---|---|---|---|
| 2015/0123955 | A1* | 5/2015 | Bi | G09G 3/3275 345/694 |
| 2016/0180763 | A1* | 6/2016 | Park | G09G 3/3258 345/691 |
| 2016/0189628 | A1* | 6/2016 | Choi | G09G 3/3233 345/77 |
| 2017/0032743 | A1* | 2/2017 | Lee | G09G 3/3233 |
| 2019/0005883 | A1* | 1/2019 | Kim | G09G 3/3258 |
| 2019/0311672 | A1 | 10/2019 | Jeong | |
| 2019/0340980 | A1* | 11/2019 | Yum | G09G 3/3258 |
| 2020/0051508 | A1* | 2/2020 | Tan | G09G 3/3291 |
| 2020/0111423 | A1* | 4/2020 | Orio | G09G 3/3291 |
| 2020/0143750 | A1* | 5/2020 | Gao | G09G 3/3233 |
| 2020/0279519 | A1* | 9/2020 | Orio | G09G 3/2011 |

FOREIGN PATENT DOCUMENTS

| | | | |
|---|---|---|---|
| TW | 201640482 | A | 11/2016 |
| TW | 201923733 | A | 6/2019 |

* cited by examiner

*Primary Examiner* — Jeff Piziali
(74) *Attorney, Agent, or Firm* — Winston Hsu

(57) ABSTRACT

The present invention provides an image processing circuit for compensating image data for a display panel used for displaying first and second image patterns respectively having first and second current loadings. The image processing circuit is used for: receiving a first original image data of the first image pattern and a second original image data of the second image pattern having the same brightness value for a pixel at the same location; converting the first original image data into a first final image data to compensate for an IR drop according to the first current loading; and converting the second original image data into a second final image data to compensate for the IR drop according to the second current loading. The first final image data and the second final image data have substantially the same brightness value for the pixel at the same location.

18 Claims, 10 Drawing Sheets w/o IR drop compensation

| | | |
|---|---|---|
| 1419 | 1333.6 | 1289.6 |
| 1639.8 | 1540.7 | 1423.3 |
| 1994.6 | 1908 | 1737.6 |

| | | |
|---|---|---|
| 71% | 67% | 65% |
| 82% | 77% | 71% |
| 100% | 96% | 87% |

U = 65% with IR drop compensation

| | | |
|---|---|---|
| 1705.8 | 1742.1 | 1760.9 |
| 1723.0 | 1687.4 | 1719.0 |
| 1769.7 | 1721.3 | 1606.3 |

| | | |
|---|---|---|
| 96% | 98% | 100% |
| 97% | 95% | 97% |
| 100% | 97% | 91% |

U = 91%

IR drop compensation image

IR drop compensation simulation:
- Before compensation, the uniformity is 65%
- After compensation, the uniformity is improved to 91%

| Pattern No. | OPR | Current ratio | Correction value |
|---|---|---|---|
| 1 | 10% | 7% | -125 |
| 2 | 20% | 16% | -109 |
| 3 | 30% | 26% | -97 |
| 4 | 40% | 32% | -93 |
| 5 | 50% | 44% | -70 |
| 6 | 60% | 56% | -58 |
| 7 | 70% | 60% | -47 |
| 8 | 80% | 68% | -47 |
| 9 | 90% | 81% | -19 |
| 10 | 100% | 100% | 0 |

IMAGE PROCESSING CIRCUIT AND METHOD FOR COMPENSATING FOR IR DROP ON DISPLAY PANEL

CROSS REFERENCE TO RELATED APPLICATIONS

This application claims the benefit of U.S. Provisional Application No. 63/050,870, filed on Jul. 12, 2020, the contents of which are incorporated herein by reference.

BACKGROUND OF THE INVENTION

1. Field of the Invention

The present invention relates to an image processing circuit and method for a display panel, and more particularly, to an image processing circuit and method for compensating for IR drop and current loading of the display panel.

2. Description of the Prior Art

FIGS. 1A and 1B illustrate a cause of IR drop. On a current driving display panel such as an organic light-emitting diode (OLED) panel, due to the change of display content, IR drop of varying degrees may appear on power lines. Therefore, different display positions may show different brightness under the same display content due to different distances from the power source, resulting in poor brightness or chromaticity consistency.

For example, as the power circuit model of an OLED panel shown in FIG. 1A, there are parasitic resistors (denoted by R) on the power lines between each pixel on the OLED panel. The power source, located below the panel, may supply the voltage ELVDD for the entire panel. Although the voltage of power output is ELVDD, a voltage drop $\Delta V$ may appear on every resistor R, and the farther away from the power source, the greater the voltage drop. For example, the voltage drop $\Delta V_4$ appearing on an upper pixel may be greater than the voltage drop $\Delta V_1$ appearing on a lower pixel.

In addition, the formula $\Delta V = I \times R$ of Ohm's law means that larger power drop may appear under a greater passing current; hence, if more pixels are lit on, the generated current will be larger, and the IR drop phenomenon will be more evident. Referring to the left figure of FIG. 1B, if the OLED panel shows an all-white image pattern (i.e., the on pixel ratio (OPR) equals 100%), although all pixels receive white display data, lower brightness may be measured at the position farther from the power source, i.e., the brightness/chromaticity are inconsistent at different positions. Since the picture is all-white, the entire OLED current will be quite large, and the degree of IR drop will also be larger. In this figure, the number shown in the circle represents the brightness value measured at the position, which shows that the brightness is higher at the position closer to the power source and the brightness is lower at the position farther from the power source. With the occurrence of IR drop, the voltage value ELVDD received by the pixel decreases gradually from bottom to up, causing that the brightness reduces gradually. The right figure of FIG. 1B shows an all-black or dark image pattern (the OPR equals 5%), except that a small area in the middle is lit on to show white. The total current loading of this image pattern is quite small; that is, the overall loading caused by current consumption of the panel is quite small since there are only a few lit-on pixels consuming OLED current. Please note that, as can be seen by comparing the all-white and all-black image patterns, even if the same brightness needs to be shown on the pixel at the same position, the image pattern with different current loading may also cause different magnitudes of IR drop confronted by the pixel; this is because the total currents of the panel are different.

FIG. 2 illustrates the comparison of various image patterns with different OPRs, i.e., the size of white area shown on each image is different. The white areas are those having lit-on pixels with current passing through. Since the OPR of each image pattern is different such that their total current amount is different, the brightness at the middle position of each image pattern still possesses difference even if the middle area of each image pattern receives the white gray-scale data. This non-uniformity of brightness degrades the visual effects of the image. Thus, there is a need for improvement over the prior art.

SUMMARY OF THE INVENTION

It is therefore an objective of the present invention to provide a novel image processing circuit and method for IR drop compensation of the display panel, where the image processing circuit and method are capable of compensating for IR drop at different positions of the panel, and also compensating for the difference of IR drop magnitude due to different current loading generated by various image patterns.

An embodiment of the present invention discloses an image processing circuit for compensating image data for a display panel. The display panel is used for displaying a first image pattern having a first current loading and a second image pattern having a second current loading different from the first current loading. The image processing circuit is used for performing steps of: receiving a first original image data of the first image pattern and a second original image data of the second image pattern, wherein the first original image data and the second original image data have the same brightness value for a pixel at the same location of the first image pattern and the second image pattern; converting the first original image data into a first final image data to compensate for an IR drop of the first image pattern according to the first current loading, to display the first image pattern based on the first final image data; and converting the second original image data into a second final image data to compensate for the IR drop of the second image pattern according to the second current loading, to display the second image pattern based on the second final image data. Wherein, the first final image data and the second final image data have substantially the same brightness value for the pixel at the same location of the first image pattern and the second image pattern.

Another embodiment of the present invention discloses an image processing circuit for compensating image data for a display panel. The display panel is used for displaying an image pattern having a current loading. The image processing circuit is used for performing steps of: receiving an original image data of the image pattern to be displayed on the display panel; generating a compensation value for the original image data according to an IR drop generated by the image pattern; generating a correction value according to the current loading; compensating the original image data with the correction value and the compensation value to generate a final image data; and driving the display panel based on the final image data, to control the display panel to display the image pattern.

Another embodiment of the present invention discloses a method of compensating image data for a display panel displaying an image pattern having a current loading. The method comprises steps of: receiving an original image data of the image pattern to be displayed on the display panel; generating a compensation value for the original image data according to an IR drop generated by the image pattern; generating a correction value according to the current loading; compensating the original image data with the correction value and the compensation value to generate a final image data; and driving the display panel based on the final image data, to control the display panel to display the image pattern.

These and other objectives of the present invention will no doubt become obvious to those of ordinary skill in the art after reading the following detailed description of the preferred embodiment that is illustrated in the various figures and drawings.

DETAILED DESCRIPTION

The present invention provides an image compensation method and a related image processing circuit, which may compensate the non-uniformity of brightness between different image patterns caused by different on pixel ratios (OPRs) in addition to compensating the IR drop to adjust the brightness of different areas on the same picture to be identical. In detail, the image processing circuit may dynamically analyze the content of each input image to acquire the degree of IR drop at each position, to adjust the compensation value at each position accordingly, so as to increase the uniformity of image brightness and remove color cast. In addition, the image processing circuit may further consider the OPR of each image pattern in the compensation, so as to ensure that the uniformity of brightness can keep consistent under different OPRs of image.

Figure 3:
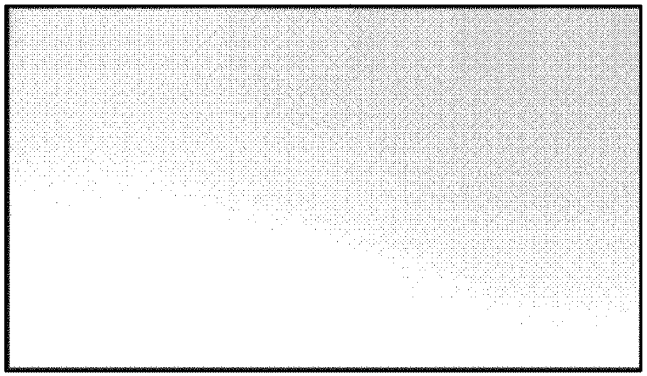
FIG. 3 illustrates the phenomenon of non-uniform brightness on the screen due to the IR drop and a simulation result of compensation.
Figure 3:
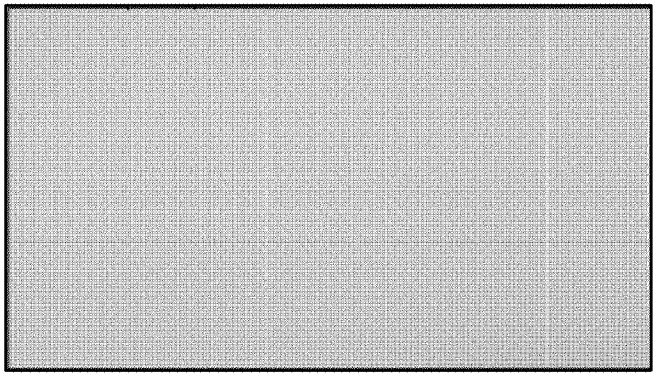
Figure 3:
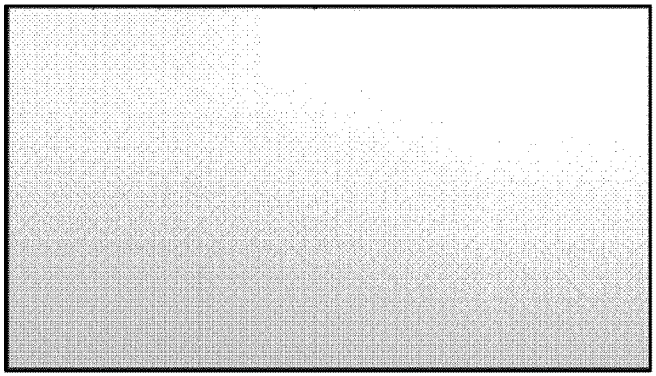

Please refer to FIG. 3, which illustrates the phenomenon of non-uniform brightness on the screen due to the IR drop and a simulation result of compensation. As shown in the upper-left figure, when there is no IR drop compensation, the brightness distribution will be brighter at the lower side and darker at the upper side if the current source or power supply of the screen is at the bottom. Simulation indicates that the uniformity of this image is 65%; that is, under the same display data, the brightness of the darkest area is substantially 65% of the brightness of the brightest area. The upper-right figure is the brightness distribution corresponding to compensation data for the image frame, where the brightness is larger at the upper side and smaller at the lower side, as being opposite to the original image. The image after compensation appears to have the brightness distribution as the lower-left figure, and its image uniformity is significantly improved to 91% under the simulation.

In addition, the non-uniformity of brightness between different images due to different OPRs may also be compensated. No matter which image is displayed, the image compensation method of the present invention may perform brightness correction according to image content. As for different OPRs such as the image patterns shown in FIG. 2, although the brightness at the center white area in different image patterns may be influenced by the value of the OPR, the image compensation method of the present invention may compensate for the brightness difference resulting from different OPRs, to improve the uniformity of brightness between different image patterns.

Figure 4:
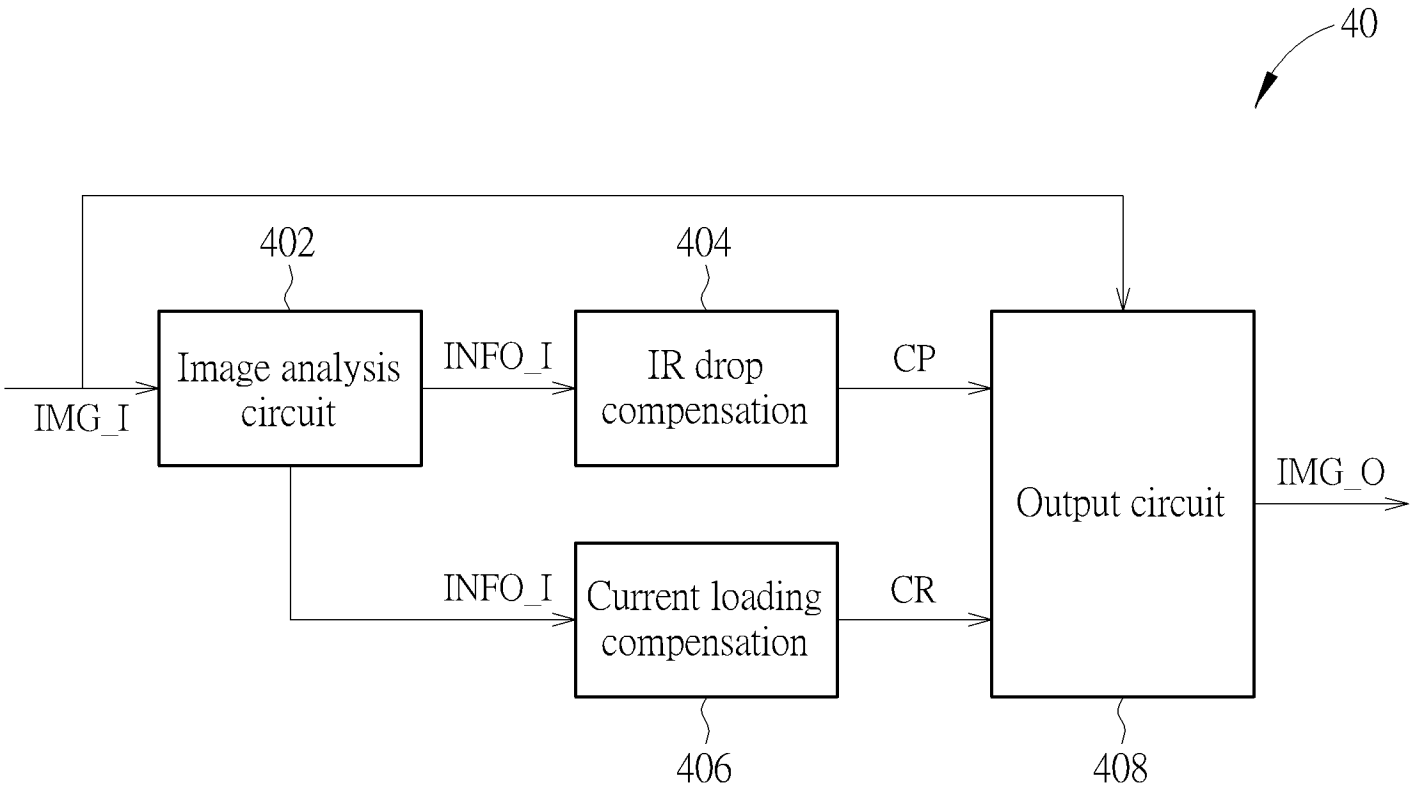
FIG. 4 is a schematic diagram of an image processing circuit according to an embodiment of the present invention.

Please refer to FIG. 4, which is a schematic diagram of an image processing circuit 40 according to an embodiment of the present invention. As shown in FIG. 4, the image processing circuit 40 includes an image analysis circuit 402, an IR drop compensation circuit 404, a current loading compensation circuit 406 and an output circuit 408. The image processing circuit 40 may process the image data to be sent to a display panel; i.e., modify the image data to compensate for various defects and optimize the displayed image.

The image analysis circuit 402 is used for receiving original image data IMG_I to be displayed on the display panel such as an organic light-emitting diode (OLED) panel, and performing processing on the original image data IMG_I to facilitate the compensation. In detail, the image analysis circuit 402 may divide the image data IMG_I into multiple blocks and calculate the current information INFO_I of each block. As for the compensation for the IR drop and current loading, the current information INFO_I is used to determine the magnitude of IR drop at each position of the panel and the OPR level of the image pattern.

Figure 5:
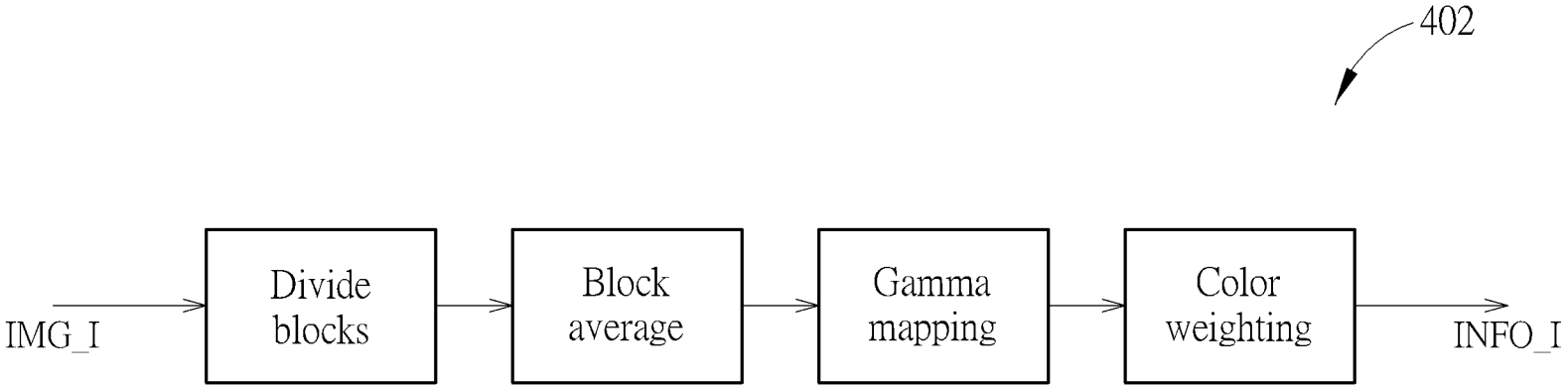
FIG. 5 illustrates an exemplary flowchart of the image analysis circuit according to an embodiment of the present invention.

FIG. 5 illustrates an exemplary flowchart of the image analysis circuit 402 according to an embodiment of the present invention. In this embodiment, the image analysis circuit 402 may divide a frame of image data IMG_I into multiple blocks (e.g., 8×8 blocks), and the grayscale values of each color are averaged in each block. In detail, the image analysis circuit 402 may obtain an average red grayscale value, an average green grayscale value, and an average blue grayscale value in each block. In order to calculate the current of each block, the grayscale values may be converted into the gamma domain through gamma mapping, and the gamma value may directly correspond to the magnitude of brightness. Subsequently, since the OLEDs of different colors have different luminous efficiency, the color weighting should be correspondingly calculated to obtain the operating current of the OLEDs of each color in each block, to obtain the red OLED current, the green OLED current, and the blue OLED current in each block. In general, the luminous efficiency of the blue OLED is lower than that of the red and green OLEDs. Therefore, under the same gamma value or brightness, the blue OLED should pass a greater current, and thus should multiply a larger weighting for the calculation of current value. In this manner, the total current value of each block may be acquired, and the image analysis circuit 402 may send the related current information INFO_I to follow-up circuits for compensation.

Based on the current information INFO_I, the image compensation may be performed in the IR drop compensation circuit 404 and the current loading compensation circuit 406. In an embodiment, the compensation may be performed by modifying the grayscale data of the input image.

In the IR drop compensation circuit 404, the compensation value CP for the image data is generated according to the IR drop, which may be calculated based on the current accumulation distribution in each block. If the current source for supplying current to the panel is disposed below the panel, the current amount may be accumulated from bottom to up. In this embodiment, the current accumulation distribution of a block refers to the consumed current magnitude on the path from the current source to the block. The current accumulation values of the upper blocks may be greater, which means that these blocks are more affected by the IR drop, and thus larger compensation values may be required. Therefore, the IR drop compensation circuit 404 may provide larger compensation values CP for the image data in the upper blocks (i.e., those blocks farther from the current source).

Figure 1A:
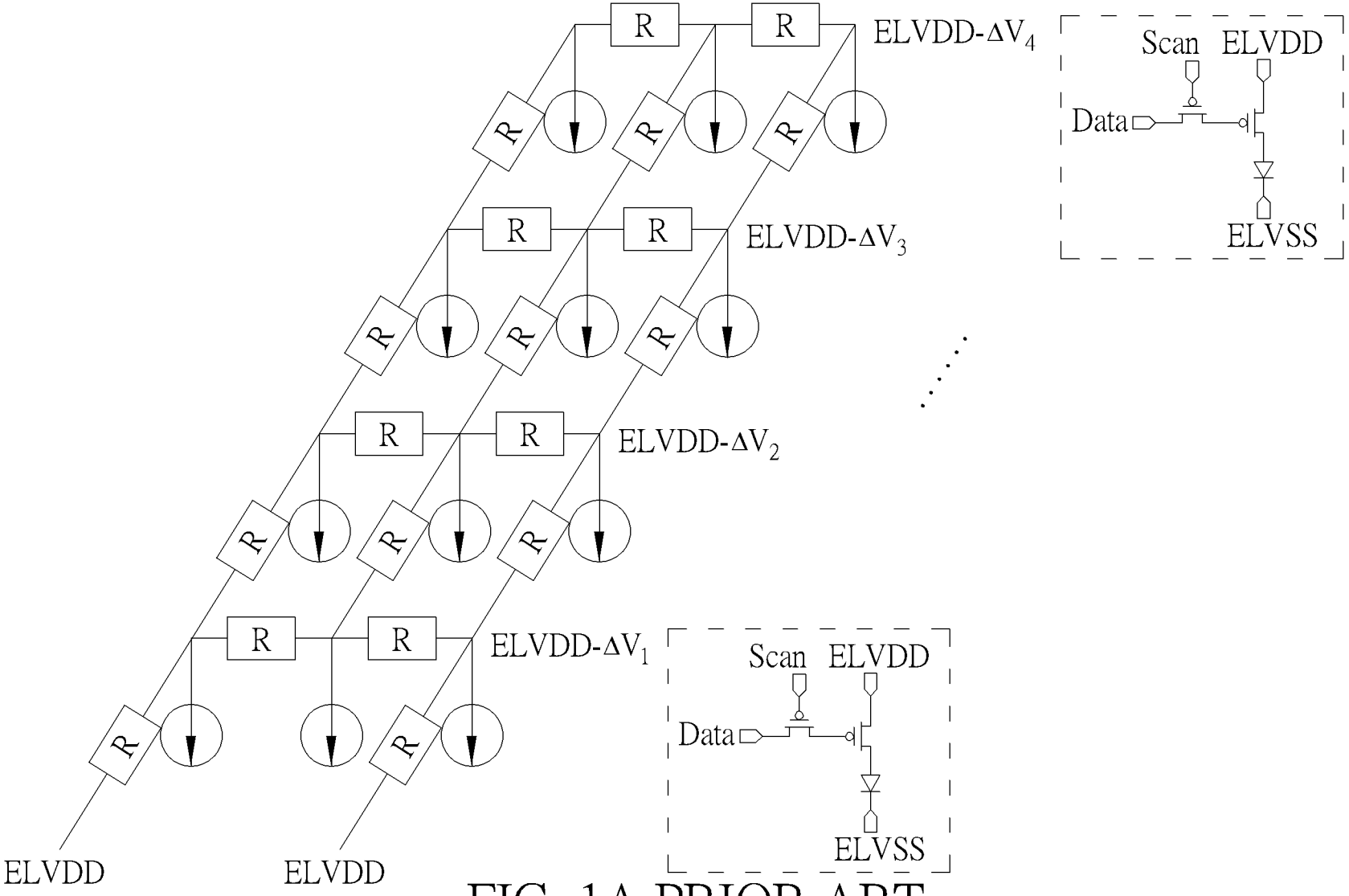
FIG. 1A PRIOR ART
FIGS. 1A and 1B are schematic diagrams of a cause of IR drop.
Figure 1B:
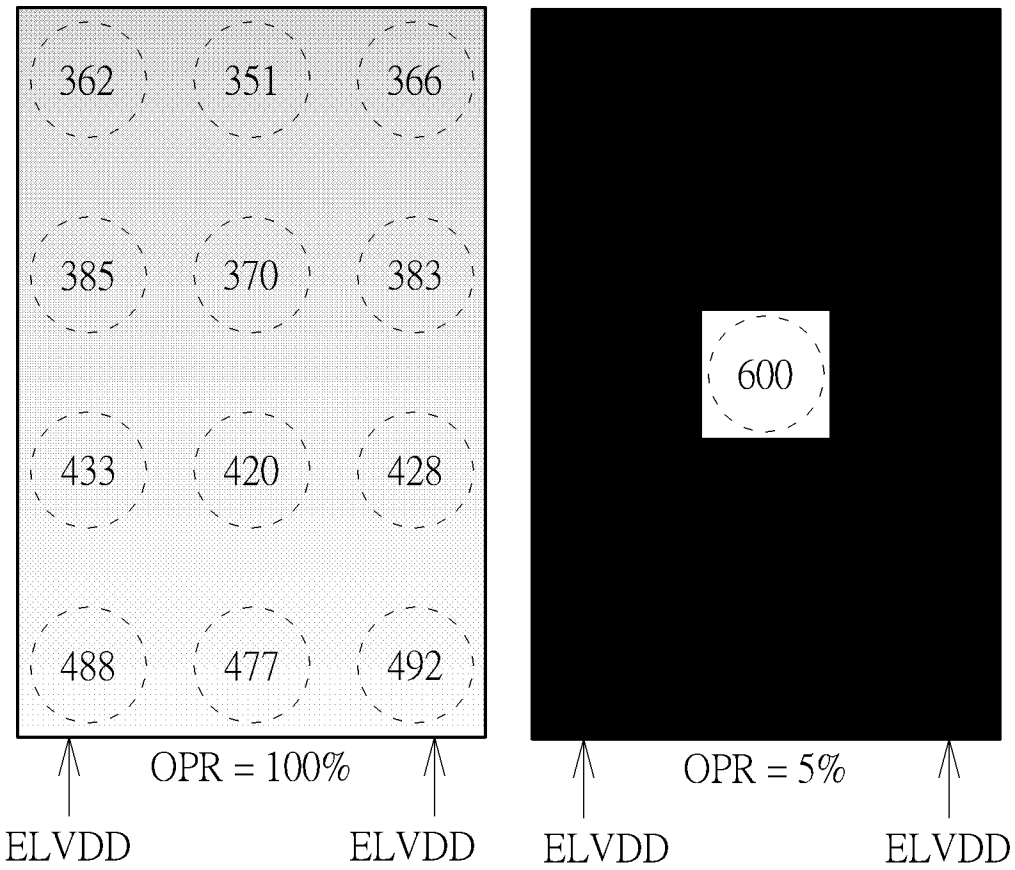
FIG. 1B PRIOR ART
Figure 2:
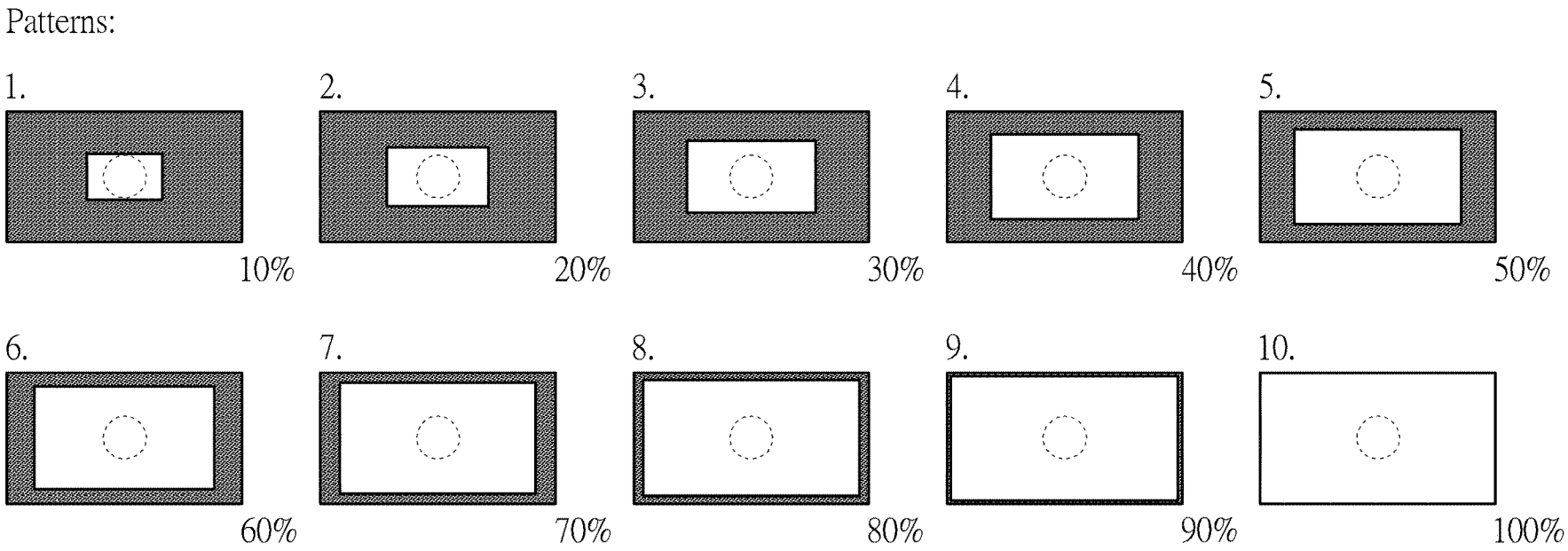
FIG. 2 PRIOR ART
FIG. 2 illustrates the comparison of various image patterns with different OPRs.

In the current loading compensation circuit 406, a correction value may be generated according to the current loading of the image pattern, where the current loading may be calculated based on the total current consumption on the display panel generated by the image pattern, which may correspond to the OPR of the image pattern. In an embodiment, the current loading compensation circuit 406 may sum up the current of each block to obtain the total current loading based on the received current information INFO_I. Alternatively, the current loading compensation circuit 406 may receive the value of the total current from the IR drop compensation circuit 404 or the image analysis circuit 402. As the image patterns of FIG. 2 shown above, different OPRs may lead to different brightness of the pixel at the same position even if the received image data are the same. The current loading compensation circuit 406 may compensate for the brightness difference caused by the OPRs based on the current loading information. After the compensation for current loading, in the image patterns of FIG. 2, the brightness of pixels at the central region in all the image patterns will keep consistent.

In an embodiment, the current loading compensation circuit 406 may dynamically compare the total current loading of each input image data and a default current loading of a predefined image pattern, to determine a current ratio corresponding to the current loading, thereby determining the correction value of current loading compensation. In an embodiment, this default image pattern may be an image pattern with the heaviest loading such as an all-white image. Therefore, as for the image patterns of FIG. 2, the compensation value of the pattern No. 10 needs not to be corrected based on the current loading, and other patterns No. 1-9 have corresponding current ratios and correction values, respectively. The current ratios and the corresponding correction values may be recorded in a lookup table (LUT), as shown in FIG. 6, and the current loading compensation circuit 406 may refer to the LUT to acquire the correction value based on the total current loading of the received image pattern.

Figure 6:
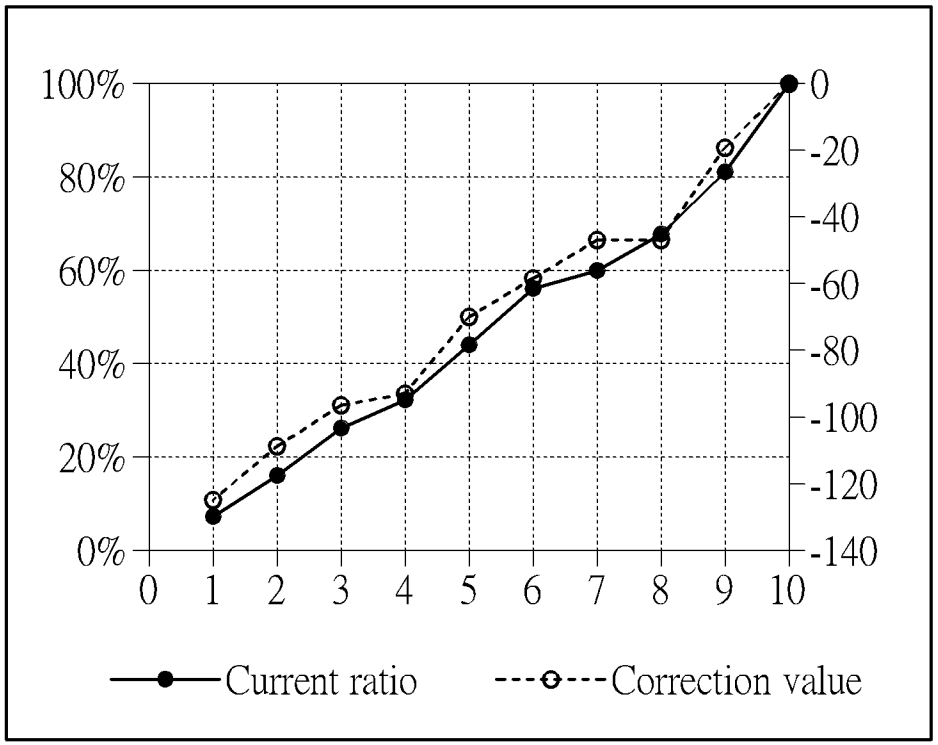
FIG. 6 is a schematic diagram of an LUT and a related line graph recording to an embodiment of the present invention.

As shown in FIG. 6, with respect to the all-white image, the current ratio of the pattern No. 10 equals 100%, and the correction value will be 0. As for the pattern No. 9, the OPR is 90% and the current ratio as compared to the all-white image may be 81%, and the corresponding correction value is −19. As for the pattern No. 8, the OPR is 80% and the current ratio as compared to the all-white image may be 68%, and the corresponding correction value is −47. The correction values for other OPRs may be obtained in similar manner based on the LUT. In this embodiment, the correction value may generate a deduction on the compensation value for the IR drop, and the image data with less current loading should deduct a larger correction value (as the line graph shown in FIG. 6), so as to compensate for the brightness difference caused by the total current loading. As a result, the pixel at the same position of different image patterns (e.g., a pixel at the central region) can still be kept with substantially consistent brightness under the same image data (e.g., the white image) after compensation.

In an embodiment, after compensation for the current loading performed on the image data for different image patterns, the uniformity of brightness may reach a satisfactory level. For example, the brightness difference of the pixel at the same location and expected to show the same image between different image patterns may be within 5% of the displayed brightness.

As can be seen in FIG. 6, the current ratio may increase with the rising OPR, but the value of the current ratio is not exactly identical to the value of the OPR. In general, the current ratio and the corresponding correction value may be obtained based on a test or experiment result of the panel. The values obtained in the test/experimental process may be recorded and stored in the LUT, allowing the current loading compensation circuit 406 to refer to the LUT according to the total current of the image pattern, so as to obtain an adequate correction value. Note that the values shown in FIG. 6 are merely based on the experimental result of an exemplary display panel, and belong to one of various embodiments of the present invention. According to the present invention, different panels may have different illumination characteristics, and thus different correction values may be obtained for different panels under the same image patterns and current ratios.

In an embodiment, the LUT may record the correction value corresponding to parts of the current ratios, and the correction values corresponding to other non-recorded current ratios may be obtained through interpolation or extrapolation.

Figure 7:
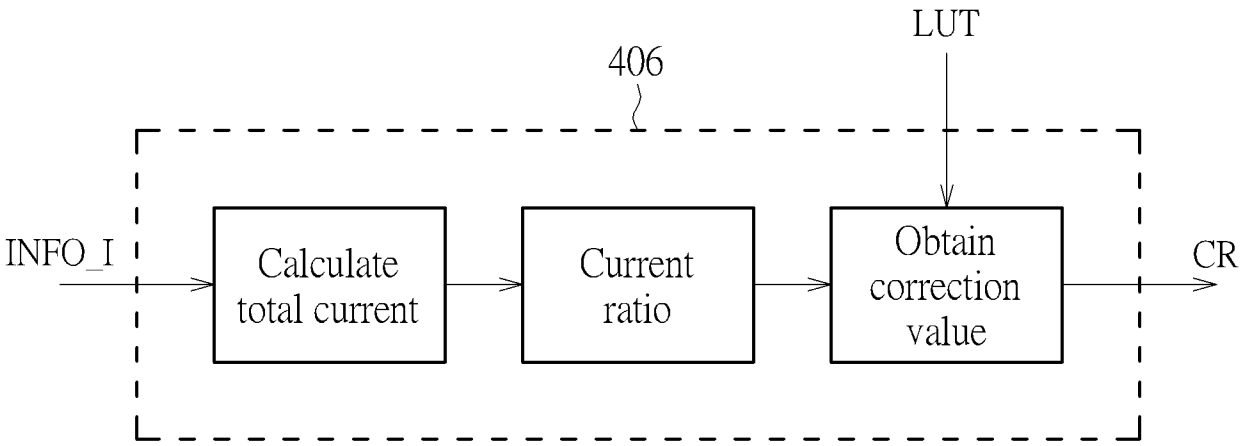
FIG. 7 is a schematic diagram of a detailed implementation of the current loading compensation circuit according to an embodiment of the present invention.

Referring back to FIG. 4 and also referring to FIG. 7, the current loading compensation circuit 406 may receive the current information INFO_I and calculate the total current of the image pattern, e.g., by summing up the current of each block. The current loading compensation circuit 406 then calculates the current ratio of the received image pattern with respect to the all-white image, and obtains the correction value CR based on the current ratio by referring to the LUT. The correction value CR may correct the compensation value CP to be used in the image compensation; that is, the correction value CR based on the total current loading in conjunction with the compensation value CP of IR drop are applied in the image compensation to generate the final image data IMG_O. Supposing that the received image frame is divided into 8×8 blocks, these 64 blocks may have a respective compensation value for IR drop obtained through the IR drop compensation circuit 404, which commonly deducts the correction value obtained through the current loading compensation circuit 406 to calculate the final compensation value for each block. As shown in FIG. 4, the output circuit 408 may receive the compensation value CP of IR drop from the IR drop compensation circuit and receive the correction value CR of current loading from the current loading compensation circuit, and compensation the received original image data IMG_I with the compensation value CP and the correction value CR to generate the final image data IMG_O. Alternatively, the IR drop compensation circuit 404 may receive the correction value CR from the current loading compensation circuit 406 and deduct the correction value CR from the original compensation value for IR drop, so as to generate the final compensation value including IR drop compensation and current loading compensation.

Figure 8:
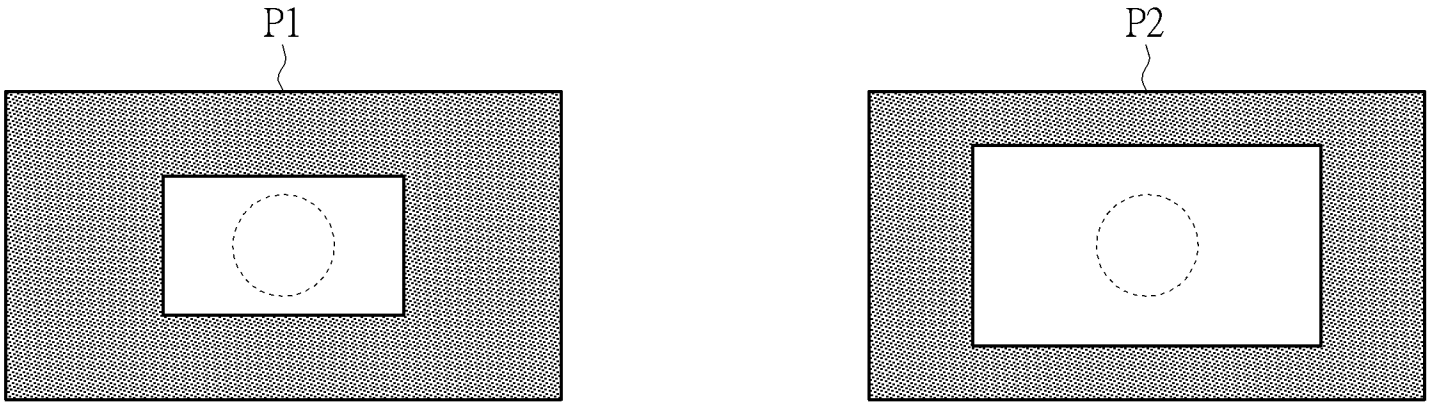
FIG. 8 illustrates two image patterns having different OPRs received by the image processing circuit for compensation.

FIG. 8 illustrates two image patterns P1 and P2 having different OPRs received by the image processing circuit 40 for compensation. These two image patterns P1 and P2 may be two of various image patterns excerpted from FIG. 2. More specifically, the image patterns P1 and P2 are composed of white and black colors, where black occupies a larger area in the image pattern P1 and white occupies a larger area in the image pattern P2, so that the OPR of the image pattern P2 is greater than the OPR of the image pattern P1, and the current loading of the image pattern P2 is higher than the current loading of the image pattern P1. The original image data IMG_I of the image pattern P1 and the original image data IMG_I of the image pattern P2 have the same brightness value for a pixel at the same location; e.g., in the central region of the image patterns P1 and P2 (as marked by a circle).

Therefore, according to the current loading, the image processing circuit 40 may convert the original image data IMG_I of the image patterns P1 and P2 into final image data IMG_O, to compensate for the IR drop and current loading of the image patterns P1 and P2. The image processing circuit 40 thereby drives the panel based on the final image data IMG_O, allowing the panel to display the image patterns P1 and P2, respectively. Since the current loading of the image pattern P2 is higher than the current loading of the image pattern P1, the correction value for the image pattern P1 is greater than the correction value for the image pattern P2 (e.g., based on the LUT), so as to improve the uniformity of image brightness between the image patterns P1 and P2. After compensation, the final image data IMG_O of the image pattern P1 and the final image data IMG_O of the image pattern P2 may still generate substantially the same brightness value for the image patterns P1 and P2 at the central region of the image patterns P1 and P2. In other words, the final image data IMG_O of the image pattern P1 and the final image data IMG_O of the image pattern P2 allow the panel to show the same brightness in the central region in which the white image is expected to be shown. This is because both the IR drop and total current loading are taken into consideration in the compensation process.

In this embodiment, the value of the final image data IMG_O of the image pattern P1 may be different from the value of the final image data IMG_O of the image pattern P2 in the central region having white image, but these final image data IMG_O may drive the panel to show the same brightness in the central region of the image patterns P1 and P2 under different current loadings of the image patterns P1 and P2.

After the final compensation value of each block is obtained, the output circuit 408 may perform extrapolation and interpolation operations between the blocks; that is, adjustment may be performed on the border of the blocks based on the values of adjacent blocks to eliminate the boundary in the images between adjacent blocks, in order to prevent image discontinuity caused by the compensation result. The output circuit 408 may further perform offset adjustment such as other brightness adjustment for image optimization, so as to obtain the final compensation values for the pixels.

Figure 9:
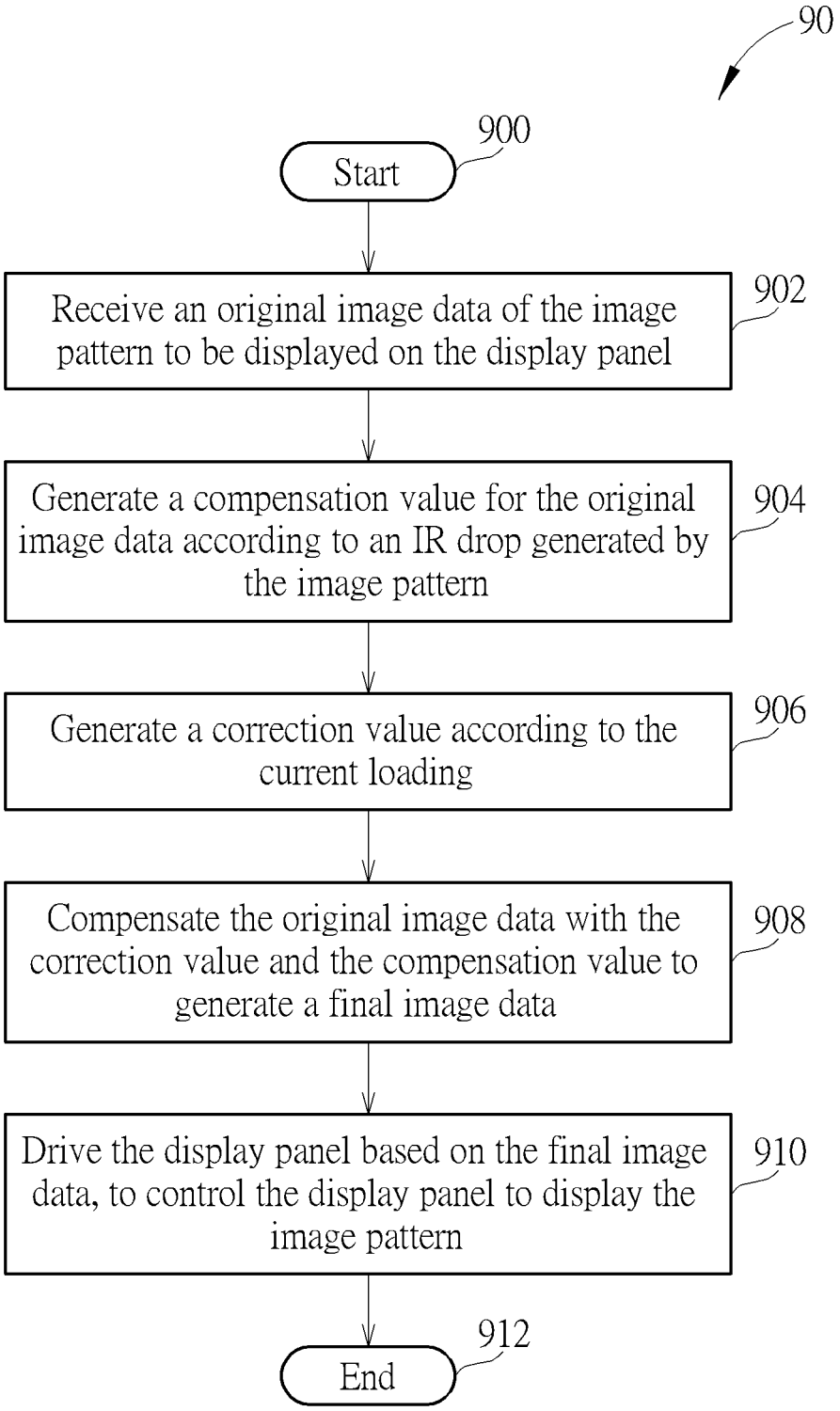
FIG. 9 is a schematic diagram of an image compensation process according to an embodiment of the present invention.

The abovementioned operations related to image compensation may be summarized into an image compensation process 90, as shown in FIG. 9. The image compensation process 90, which may be implemented in an image processing circuit for a display panel such as the image processing circuit 40, includes the following steps:

Step 900: Start.

Step 902: Receive an original image data of the image pattern to be displayed on the display panel.

Step 904: Generate a compensation value for the original image data according to an IR drop generated by the image pattern.

Step 906: Generate a correction value according to the current loading.

Step 908: Compensate the original image data with the correction value and the compensation value to generate a final image data.

Step 910: Drive the display panel based on the final image data, to control the display panel to display the image pattern.

Step 912: End

The detailed implementations and alterations of the image compensation process 90 are illustrated in the above paragraphs, and will not be narrated herein.

To sum up, the embodiments of the present invention provide an image processing circuit and method for compensating for IR drop and current loading of the display panel. In general, different image patterns may have different total current, resulting in different magnitudes of IR drop confronted by a pixel at the same position in different image patterns. Therefore, the compensation is performed not only based on the magnitude of IR drop of the respective block, but also based on the total current loading of the image pattern, where a larger current loading may cause a severe IR drop at the same position. In an embodiment, the current information may be obtained by analyzing the image data of each block, and the total current loading may be obtained by summing the currents of all blocks. Based on the current loading, the image processing circuit may determine a correction value for the IR drop compensation value, and the compensation value with correction for current loading may be applied to the original image data to generate the final image data, which is used to drive the panel to display the image. Therefore, after compensation, the final image data for different image patterns allow the panel to show substantially the same brightness at the same region in which the same image is expected to be shown. The brightness uniformity of the image may be improved accordingly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image processing circuit for compensating image data for a display panel, the display panel used for displaying a first image pattern having a first current loading and a second image pattern having a second current loading different from the first current loading, and the image processing circuit being used for:

receiving a first original image data of the first image pattern and a second original image data of the second image pattern, wherein the first original image data and the second original image data have the same brightness value for a pixel at the same location of the first image pattern and the second image pattern;

converting the first original image data into a first final image data to compensate for a voltage drop of the first image pattern according to the first current loading, to display the first image pattern based on the first final image data;

converting the second original image data into a second final image data to compensate for a voltage drop of the second image pattern according to the second current loading, to display the second image pattern based on the second final image data;

comparing the first current loading with a default current loading, to determine a current ratio corresponding to the first current loading; and determining a correction value for a compensation value of the voltage drop of the first image pattern according to the current ratio;

wherein the first final image data and the second final image data have substantially the same brightness value for the pixel at the same location of the first image pattern and the second image pattern.

2. The image processing circuit of claim 1, wherein the first current loading is a total current consumption on the display panel generated by the first image pattern, and the second current loading is a total current consumption on the display panel generated by the second image pattern.

3. The image processing circuit of claim 1, wherein the default current loading is a current loading generated by an all-white image pattern.

4. The image processing circuit of claim 1, wherein the correction value is obtained from a lookup table, which records a plurality of correction values corresponding to a plurality of current ratios, respectively.

5. The image processing circuit of claim 1, wherein the correction value for the compensation value of the voltage drop of the first image pattern generates a deduction on the compensation value.

6. The image processing circuit of claim 1, wherein the first current loading corresponds to a first correction value for a first compensation value of the voltage drop of the first image pattern, and the second current loading corresponds to a second correction value for a second compensation value of the voltage drop of the second image pattern, wherein the first correction value is greater than the second correction value when the first current loading is less than the second current loading.

7. An image processing circuit for compensating image data for a display panel, the display panel used for displaying an image pattern having a current loading, and the image processing circuit being used for:

receiving an original image data of the image pattern to be displayed on the display panel;

generating a compensation value for the original image data according to a voltage drop generated by the image pattern;

generating a correction value according to the current loading;

compensating the original image data with the correction value and the compensation value to generate a final image data; and driving the display panel based on the final image data, to control the display panel to display the image pattern;

wherein the step of generating the correction value according to the current loading comprises:

comparing the current loading with a default current loading, to determine a current ratio corresponding to the current loading; and determining the correction value for the compensation value according to the current ratio.

8. The image processing circuit of claim 7, wherein the current loading is a total current consumption on the display panel generated by the image pattern.

9. The image processing circuit of claim 7, wherein the default current loading is a current loading generated by an all-white image pattern.

10. The image processing circuit of claim 7, wherein the correction value is obtained from a lookup table, which records a plurality of correction values corresponding to a plurality of current ratios, respectively.

11. The image processing circuit of claim 10, wherein among the plurality of correction values, a first correction value corresponds to a first current loading and a second correction value corresponds to a second current loading, wherein the first correction value is greater than the second correction value when the first current loading is less than the second current loading.

12. The image processing circuit of claim 7, wherein the correction value for the compensation value generates a deduction on the compensation value.

13. A method of compensating image data for a display panel displaying an image pattern having a current loading, the method comprising:

receiving an original image data of the image pattern to be displayed on the display panel;

generating a compensation value for the original image data according to a voltage drop generated by the image pattern;

generating a correction value according to the current loading;

compensating the original image data with the correction value and the compensation value to generate a final image data; and driving the display panel based on the final image data, to control the display panel to display the image pattern;

wherein the step of generating the correction value according to the current loading comprises:

comparing the current loading with a default current loading, to determine a current ratio corresponding to the current loading; and determining the correction value for the compensation value according to the current ratio.

14. The method of claim 13, wherein the current loading is a total current consumption on the display panel generated by the image pattern.

15. The method of claim 13, wherein the default current loading is a current loading generated by an all-white image pattern.

16. The method of claim 13, wherein the correction value is obtained from a lookup table, which records a plurality of correction values corresponding to a plurality of current ratios, respectively.

17. The method of claim 16, wherein among the plurality of correction values, a first correction value corresponds to a first current loading and a second correction value corresponds to a second current loading, wherein the first correction value is greater than the second correction value when the first current loading is less than the second current loading.

18. The method of claim 13, wherein the correction value for the compensation value generates a deduction on the compensation value.

* * * * *